US007111959B2

(12) United States Patent
Kurcz et al.

(10) Patent No.: US 7,111,959 B2
(45) Date of Patent: Sep. 26, 2006

(54) METHOD AND APPARATUS TO ILLUMINATE THE INTERIOR OF A FASHION ACCESSORY

(75) Inventors: Kara Catherine Kurcz, Los Angeles, CA (US); Brian Matthew Lee, Los Angeles, CA (US)

(73) Assignee: Big Bang Industries, LLC, Los Angeles, CA (US)

( * ) Notice: Subject to any disclaimer, the term of this patent is extended or adjusted under 35 U.S.C. 154(b) by 65 days.

(21) Appl. No.: 10/972,008

(22) Filed: Oct. 22, 2004

(65) Prior Publication Data

US 2005/0057923 A1 Mar. 17, 2005

Related U.S. Application Data

(63) Continuation-in-part of application No. 10/447,784, filed on May 29, 2003, now abandoned.

(60) Provisional application No. 60/385,683, filed on Jun. 4, 2002.

(51) Int. Cl.
*F21W 121/06* (2006.01)

(52) U.S. Cl. ..... 362/156; 362/155; 362/84

(58) Field of Classification Search ..... 362/156, 362/155, 154, 802, 84
See application file for complete search history.

(56) References Cited

U.S. PATENT DOCUMENTS

| | | | | |
|---|---|---|---|---|
| 2,736,793 | A | | 2/1956 | Raymond |
| 3,182,184 | A | | 5/1965 | Echols et al. |
| 3,239,658 | A | | 3/1966 | Castaldo |
| 3,609,341 | A | | 9/1971 | Castaldo |
| 3,808,416 | A | | 4/1974 | Pottratz |
| 4,015,112 | A | | 3/1977 | Castaldo |
| 5,005,111 | A | | 4/1991 | Teal |
| 5,073,844 | A | | 12/1991 | Coyner et al. |
| 5,268,827 | A | * | 12/1993 | Granneman et al. ..... 362/156 |
| 5,444,605 | A | | 8/1995 | Rivera |
| 5,485,355 | A | * | 1/1996 | Voskoboinik et al. ..... 362/84 |
| 5,908,232 | A | | 6/1999 | Burns et al. |
| 6,120,162 | A | * | 9/2000 | Guerrieri ..... 362/155 |
| 2002/0093817 | A1 | | 7/2002 | Stone et al. |
| 2004/0090773 | A1 | * | 5/2004 | Bryan |
| 2005/0092409 | A1 | | 5/2005 | Beverly |

OTHER PUBLICATIONS

US 2004/0090773 to Bryan published May 13, 2004.*

* cited by examiner

*Primary Examiner*—Laura K. Tso
(74) *Attorney, Agent, or Firm*—Seth D. Levy; Davis Wright Tremaine LLP

(57) ABSTRACT

The invention includes an apparatus for illuminating the interior of a fashion accessory and a method for assembling the same. An illumination device may include a dual illumination source, a power source, and a switch electrically coupled to one another. The dual illumination source may be a pair of electric luminescent wires affixed to the interior of the fashion accessory. The switch may cause the dual illumination source to illuminate when the fashion accessory is opened and to turn off when the fashion accessory is closed. Various elements of the illumination device may be obscured from view by including the same behind an interior lining of the fashion accessory, and the illumination source may be selected from any suitable color so as to provide illumination of a desired color. Additionally, the power source may be rechargeable, and may be configured to power additional electronic devices.

16 Claims, 8 Drawing Sheets

METHOD AND APPARATUS TO ILLUMINATE THE INTERIOR OF A FASHION ACCESSORY

This application is a continuation-in-part of U.S. patent application Ser. No. 10/447,784, filed May 29, 2003, now abandoned, which claims the benefit of priority under 35 U.S.C. § 119 of provisional U.S. application Ser. No. 60/385,683, filed Jun. 4, 2002. The contents of both applications are hereby incorporated by reference in their entirety as if fully set forth.

FIELD OF THE INVENTION

The present invention relates to fashion accessories and, more particularly, to a method and apparatus for illuminating the interior of the same.

BACKGROUND OF THE INVENTION

Individuals frequently employ any number of portable fashion accessories to transport their personal effects. For example, many women carry a purse or pocketbook, and, modern trends have seen a growth in the number of similar accessories for men beyond the traditional briefcases and attaches. A variety of items may be stored and contained within such accessories, yet, without proper illumination, locating particular items within these accessories can be both difficult and frustrating.

SUMMARY OF THE INVENTION

Embodiments of the present invention provide an apparatus and method to illuminate the interior of a fashion accessory. The illumination device of the present invention may be at least partially concealed by an interior lining of the fashion accessory, so as to reduce the visibility of the device, thereby providing an attractive final product. Moreover, the illumination may be provided by an illumination source that is stitched or otherwise affixed to at least a portion of the perimeter of the interior of the fashion accessory; for example, it may be sewn into the interior lining of the fashion accessory and/or secured to the fashion accessory by the frame of the fashion accessory. Moreover, this illumination may be provided in any number of colors, owing to a selection of one of a variety of illumination sources described in alternate embodiments of the present invention. The illumination source may also be a dual illumination source; for example, two strands of electroluminescent wire in electronic communication with a bifurcated wire that couples the strands of electroluminescent wire to a unitary power source.

Further embodiments of the present invention provide a device to illuminate the interior of a fashion accessory that switches into an "on" position when the accessory is opened and, conversely, switches into an "off" position when the accessory is closed.

Still further embodiments of the present invention provide a recharging assembly that may be used to recharge a rechargeable battery in electronic communication with the illumination source. The recharging assembly may be configured to receive external power from a cigarette lighter adapter, from a wall outlet, from a solar power source, or the like. The recharging assembly may additionally include an internal fashion accessory power outlet that may be used to power an electronic device, such as an MP3 player, a personal data assistant ("PDA"), a cellular telephone, or another electronic device.

DETAILED DESCRIPTION OF THE INVENTION

Embodiments of the present invention provide an illumination device for illuminating the interior of a fashion accessory. Such illumination may render it more convenient for one to locate a particular item contained inside that accessory, especially when ambient lighting conditions are such that one would otherwise have difficulty visually discerning among the contents of the accessory. By way of example, embodiments of the illumination device of the present invention may be useful when one is searching for a particular item in a handbag in a dimly lit room, or when trying to find car keys in a similar handbag, when in a parking lot at night.

The illumination device of the present invention has the additional benefit of imparting a new, fashionable quality to a fashion accessory, since in alternate embodiments the illumination source may be selected from a range of colors. Thus, when illuminated, the interior of the fashion accessory may be illuminated or may glow with the selected color. For example, in one embodiment of the present invention, the interior of a purse may be illuminated with light of a blue hue, when a corresponding illumination source is selected.

Moreover, in alternate embodiments of the present invention, at least a portion of the illumination apparatus may be concealed from view within the lining or another similar part of the fashion accessory; thereby minimizing or eliminating an individual's ability to see the mechanism responsible for providing the illumination effect. This may be particularly advantageous insofar as embodiments of the present invention may be included in a fashion accessory, in which one would likely prefer to obfuscate various elements of the illumination device (e.g., wiring, power source) from view to the greatest extent practicable. Thus, in a preferred embodiment of the present invention, the illumination source and switch that controls the illumination source are visible upon opening the fashion accessory, while the remaining elements of the illumination device remain substantially hidden from view.

Fashion accessories suitable for use in accordance with embodiments of the present invention include, but are in no way limited to, purses, handbags, pocketbooks, wallets, backpacks, briefcases, satchels, luggage, suitcases, cases for sunglasses or makeup, and any other suitable fashion accessory as will be readily recognized by one in the art. In preferred embodiments, the fashion accessory is a purse, handbag, or pocketbook.

Illumination sources suitable for use in accordance with embodiments of the present invention include, but are in no way limited to, tubular illumination mechanisms such as electric luminescent wire, fiber optic illumination sources, light bulbs, and the like. In one embodiment of the present invention, the illumination source is electric luminescent wire, available under the tradename LYTEC® from Elam Electroluminescent Industries, Ltd. (Jerusalem, Israel).

Figure 1:
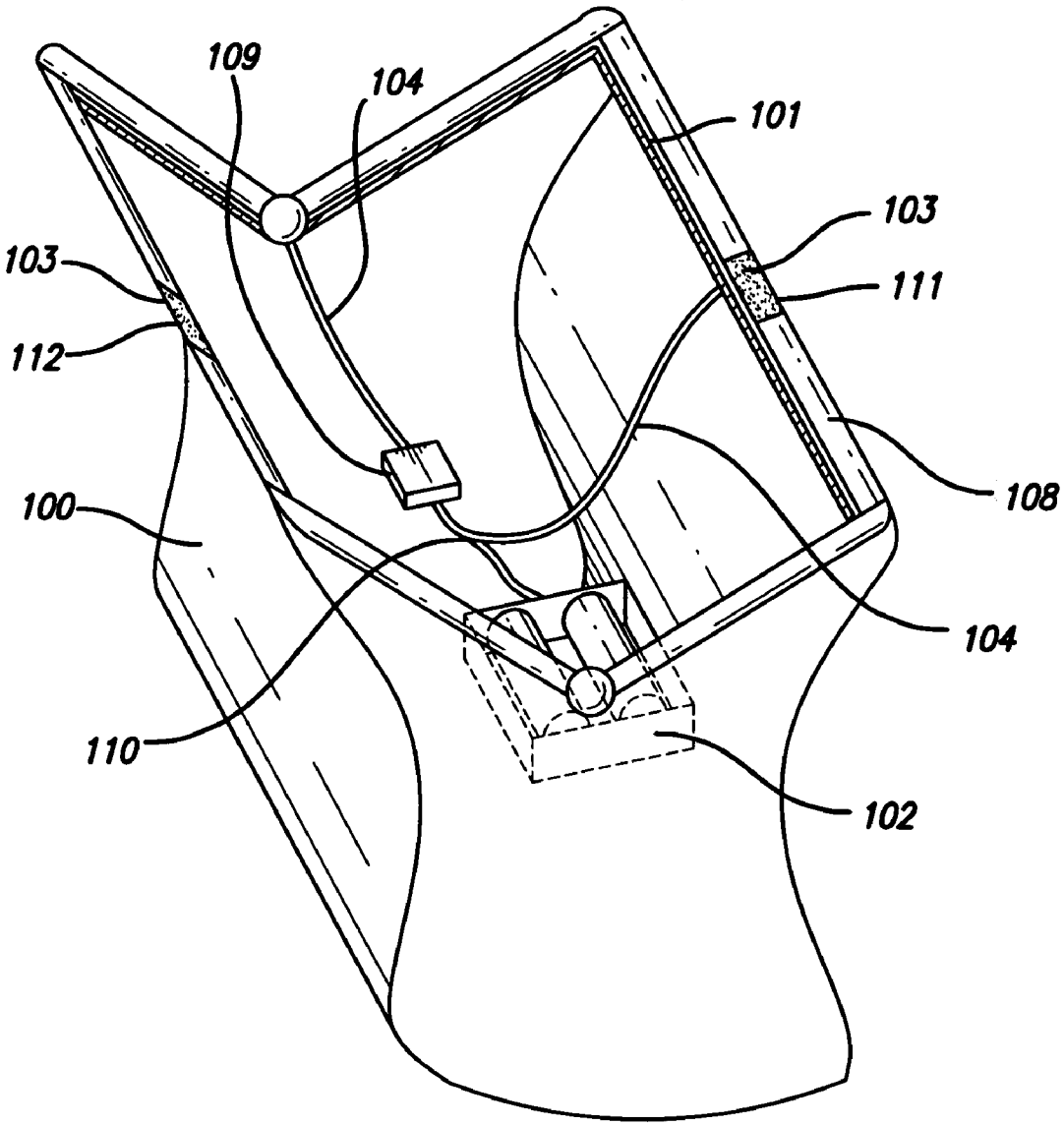
FIG. 1 illustrates a perspective view of a fashion accessory including an illumination device in accordance with an embodiment of the present invention. The fashion accessory is shown in an open position.

With reference to FIG. 1, in one embodiment of the present invention, a fashion accessory 100 includes an illumination source 101 that is electrically coupled to a power source 102. Power sources 102 suitable for use in accordance with embodiments of the present invention include, but are in no way limited to, batteries, solar cells, and the like. In a preferred embodiment of the present invention, the power source 102 includes a battery, and, in a most preferred embodiment, the power source 102 includes two AA batteries. It will be readily apparent to one in the art that the power source 102 of the present invention may be selected as appropriate to provide sufficient power, as per the electrical requirements of the illumination source 101.

Figure 8:
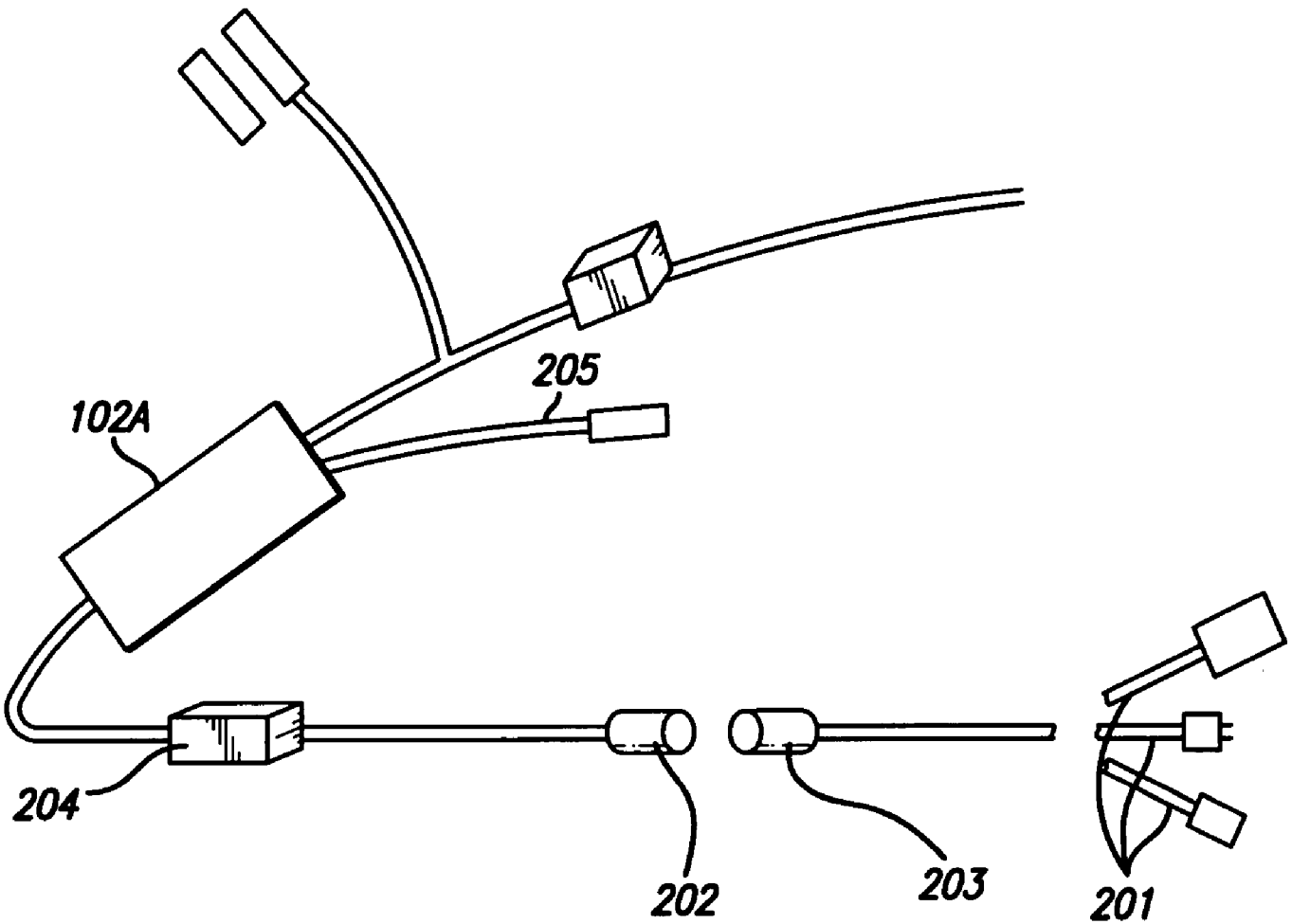
FIG. 8 illustrates a recharging assembly in accordance with an embodiment of the present invention.

In an alternate embodiment of the present invention, as depicted in FIG. 8, the power source 102 may be a rechargeable power source 102A, which may be configured to receive external power (e.g., to recharge) from an external power source 201, such as a cigarette lighter adapter, a wall outlet, a solar power source, or any other suitable source of external power. Electronic communication may be established between the rechargeable power source 102A and the external power source 201 by a pair of adaptor jacks 202, 203. The first adaptor jack 202 may be configured on the fashion accessory in a convenient location, such as a location on the accessory that is externally accessible or it may be configured on the interior of the fashion accessory to aid in hiding it from external view. A power converter 204 may be included between the rechargeable power source 102A and the pair of adaptor jacks 202, 203. The second adaptor jack 203 may be configured on a separate assembly that includes means for electronic communication between the second adaptor jack 203 and the external power source 201.

Furthermore, the recharging assembly may include an internal fashion accessory power outlet 205 that may be used to power an electronic device, such as an MP3 player, a personal data assistant ("PDA"), a cellular telephone, or another electronic device. The internal fashion accessory power outlet 205 may be configured on the interior of the fashion accessory, and may include a means for providing electronic communication between the internal fashion accessory power outlet 205 and the electronic device powered by the rechargeable power source 102A.

The illumination source 101 may be further electrically coupled to a switch 103, that controls the illumination source 101 such that the illumination source is in an "on" position when the fashion accessory 100 is open, and an "off" position when the fashion accessory 100 is closed. The switch 103 of the present invention may be any suitable switch 103 that operates to control the "on" and "off" state of the illumination source 101, but in preferred embodiments the switch 103 is a magnetic reed switch. A magnetic reed switch used in embodiments of the present invention may include two elements, as illustratively depicted in FIG. 1. A first element 111 may be electrically coupled to the power source 102, and a second element 112 may be in magnetic contact with the first element 111. In preferred embodiments of the present invention, the first element 111 and the second element 112 are affixed or otherwise attached to the opening 108 of a fashion accessory 100, such that the elements 111, 112 are in magnetic contact with one another when the fashion accessory 100 is closed, and are separated from one another when the fashion accessory 100 is opened. In such embodiments, when the fashion accessory 100 is opened, the two elements 111, 112 preferably separate to a distance far enough away from one another such that the switch 103 functions to operate the illumination source 101.

The illumination source 101, power source 102, and switch 103 may be electrically coupled by any suitable mechanism such as wires 104, although other mechanisms for providing such electric coupling will be readily apparent to one in the art. In one embodiment of the present invention, the wires 104 include a junction 110 where the wires 104 split to reach the switch 103 at one end of the junction 110 and the illumination source 101 at the other end of the junction 110.

As further depicted in FIG. 1, in an alternate embodiment of the present invention, an inverter 109 may be included between the power source 103 and the illumination source 101. The inverter 109 may adjust the power level so as to provide an appropriate amount of power to the illumination source 101. An inverter 109 is illustratively depicted in FIG. 1 between the power source 103 and the junction 110, although in alternate embodiments of the present invention, an inverter 109 may be included between the junction 110 and the illumination source 101 (not shown).

Figure 5:
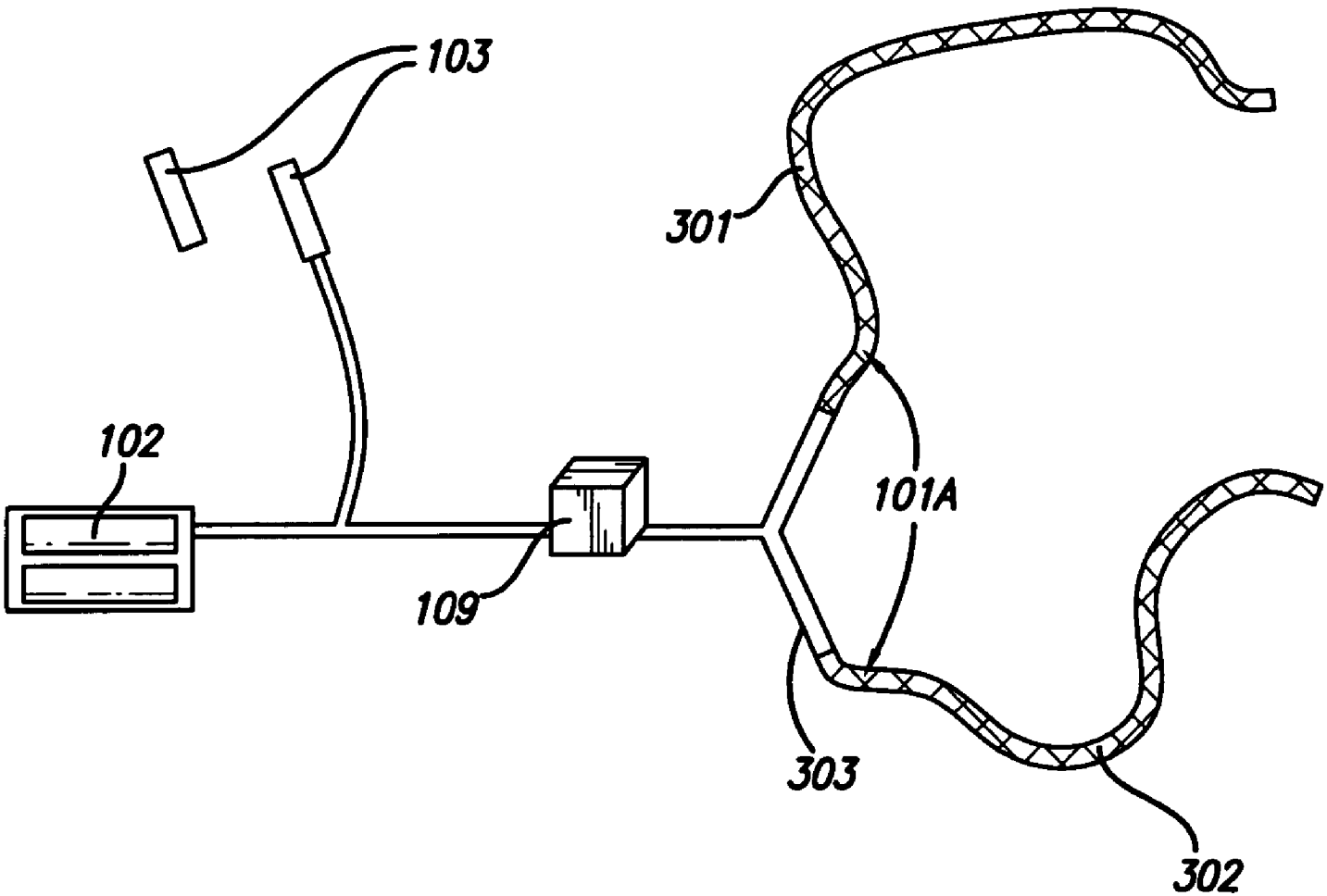
FIG. 5 illustrates an illumination device with a dual illumination source in accordance with an embodiment of the present invention, prior to installation in a fashion accessory. The dual illumination source is in electronic communication with a bifurcated wire in further electronic communication with a unitary power source.
Figure 6:
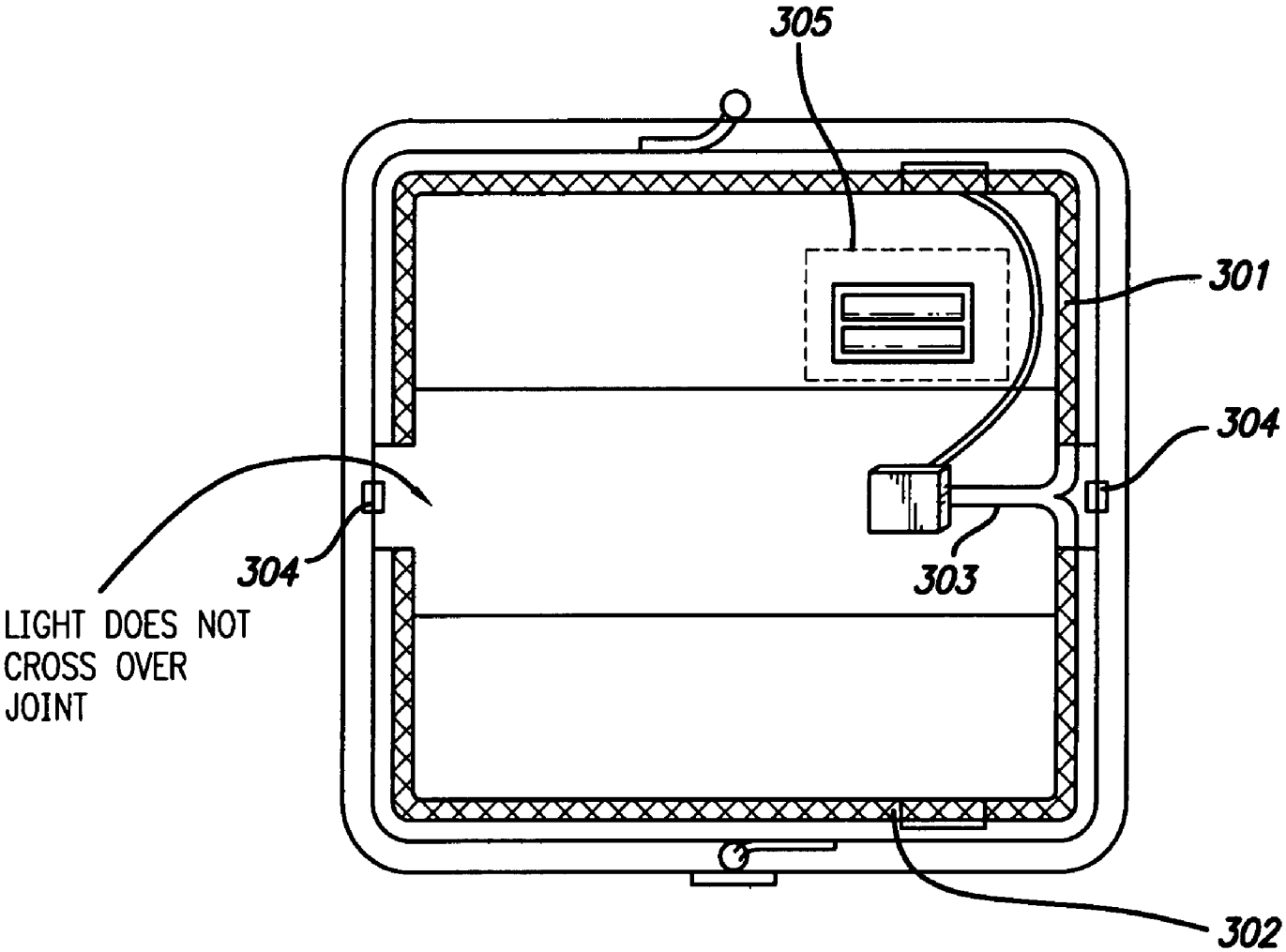
FIG. 6 illustrates a top view of a fashion accessory in accordance with an embodiment of the present invention. The fashion accessory includes a dual illumination source, and a battery pack in a battery pack holder that is stitched into an inside lining of the fashion accessory.

In an alternate embodiment of the present invention, as depicted in FIG. 5, the illumination source 101 may be a dual illumination source 101A; for example, two strands of electroluminescent wire 301, 302 in electronic communication with a bifurcated wire 303 that couples the strands of electroluminescent wire 301, 302 to a unitary power source 102. A magnetic switch 103 and inverter 109 may additionally be included in this embodiment of the present invention. As depicted in FIG. 6, particularly when the fashion accessory 100 is a purse, this configuration of the illumination device permits one to include each of the two strands of electroluminescent wire 301, 302 in the fashion accessory 100 on opposing sides of an opening in the fashion accessory 100. More particularly, each of the strands of electroluminescent wire 301, 302 may be included on a separate side of the fashion accessory opening such that no portion of either strand of electroluminescent wire 301, 302 is configured to transect the hinge 304 or other moveable element of the fashion accessory 100. Rather, the bifurcated wire 303 can be configured to transect the hinge 304. In this embodiment, the unitary power source 102 is illustrated as concealed in a pocket 305 to obscure it from view when the fashion accessory is opened. In various embodiments, the pocket 305 may include a zipper closure or the like to allow easy access to the unitary power source 102 (e.g., to change the batteries therein).

Electroluminescent wire is pliable, which allows it to be bent into a particular shape, e.g., for installation in the fashion accessory; however, electroluminescent wire tends not to stand up well to repeated bending, as the filaments therein may break. Thus, when electroluminescent wire transects the hinge of a purse or other fashion accessory, and the purse or other fashion accessory is repeatedly opened and closed (e.g., during the course of normal use), the wire may break or its function may become suboptimal. Therefore, in this particular embodiment of the present invention, the electroluminescent wire is not repeatedly bent; instead, it is only bent at the outset for installation. Thereafter, only the bifurcated wire is bent. This may markedly improve the durability of the fashion accessory and prolong the life expectancy of the illumination device.

Figure 2:
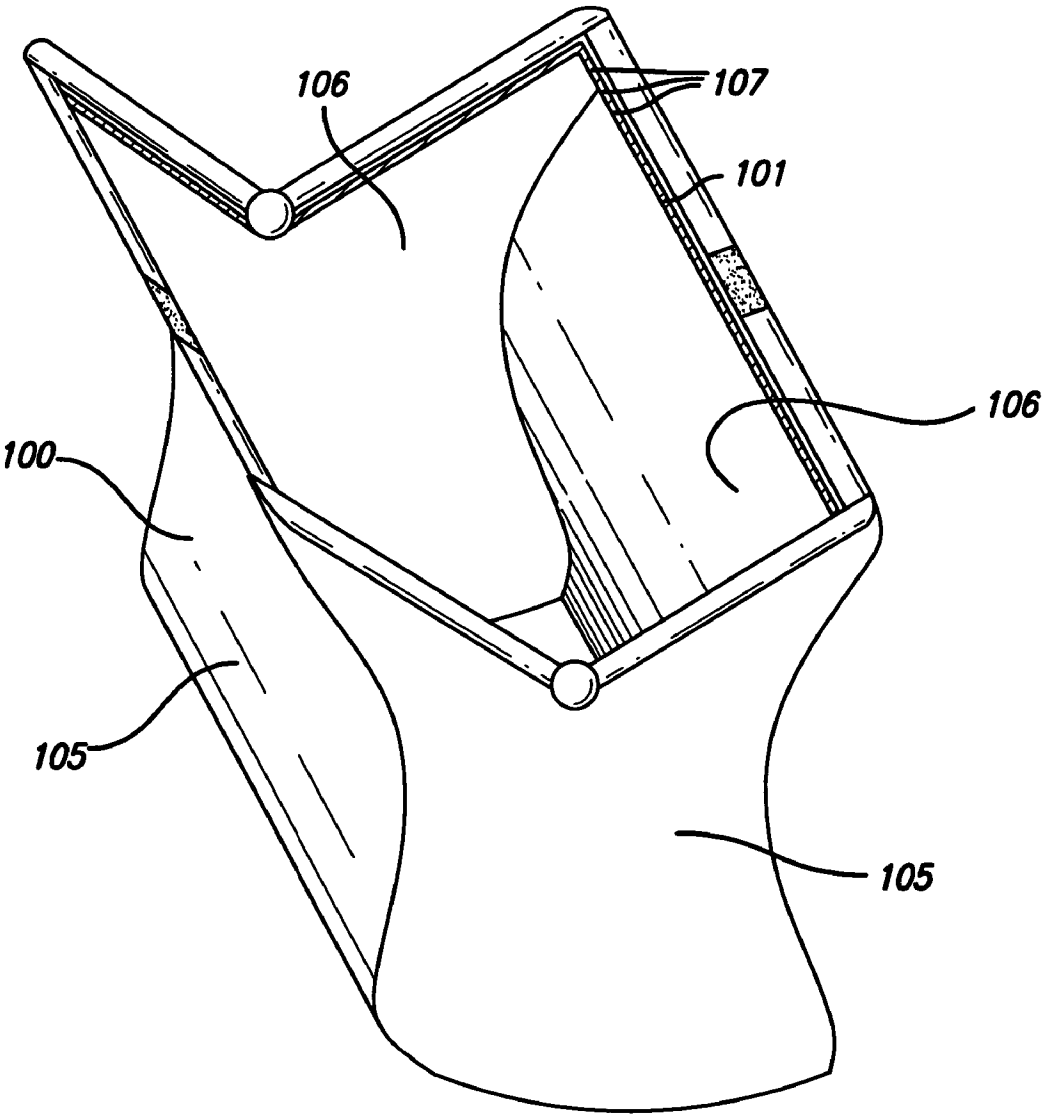
FIG. 2 illustrates a perspective view of a fashion accessory including an illumination device in accordance with an embodiment of the present invention, wherein various elements of the illumination device are obscured from view by an interior lining of the fashion accessory. The fashion accessory is shown in an open position.
Figure 3:
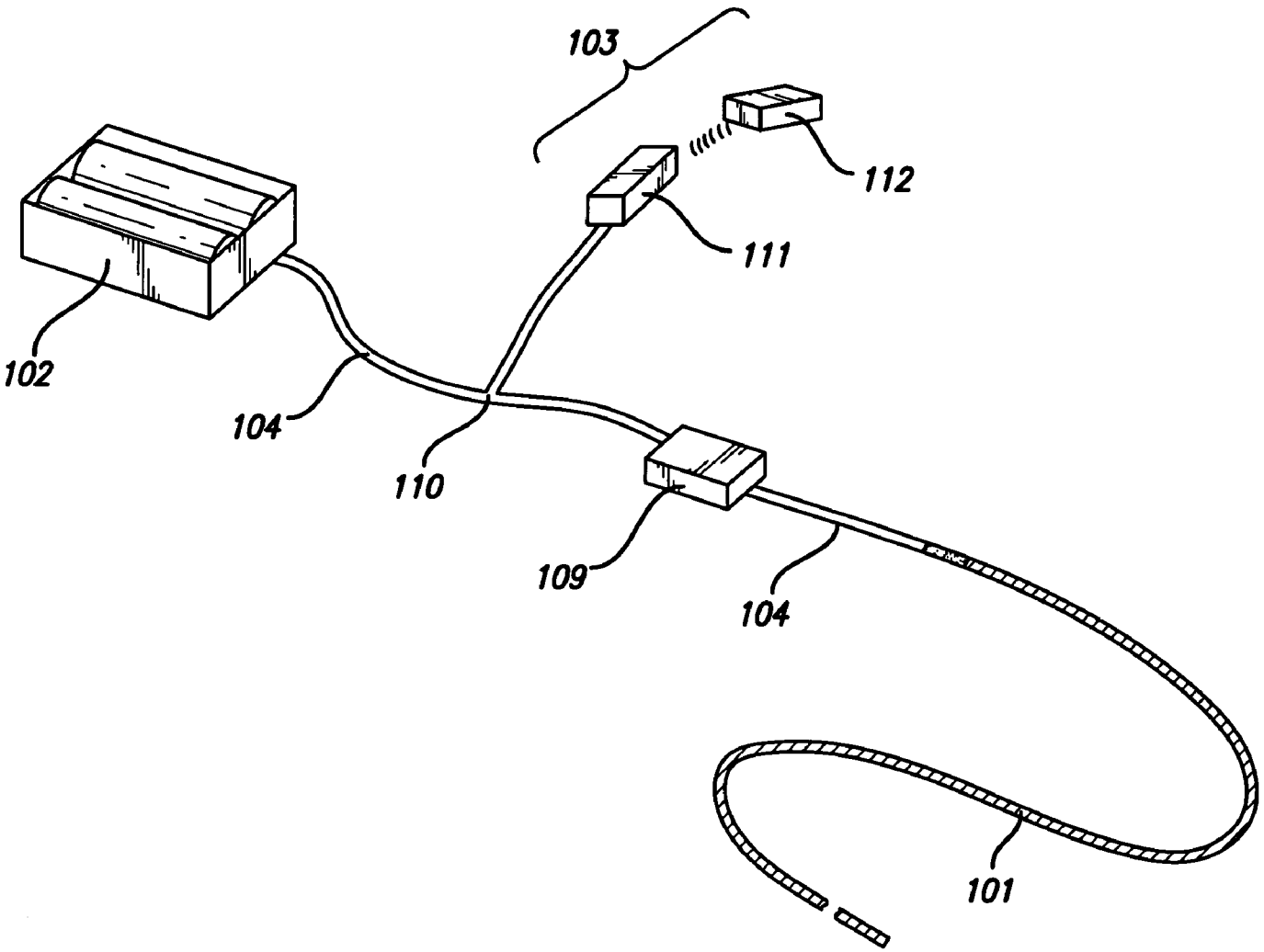
FIG. 3 illustrates an illumination device in accordance with an embodiment of the present invention, prior to installation in a fashion accessory.
Figure 7:
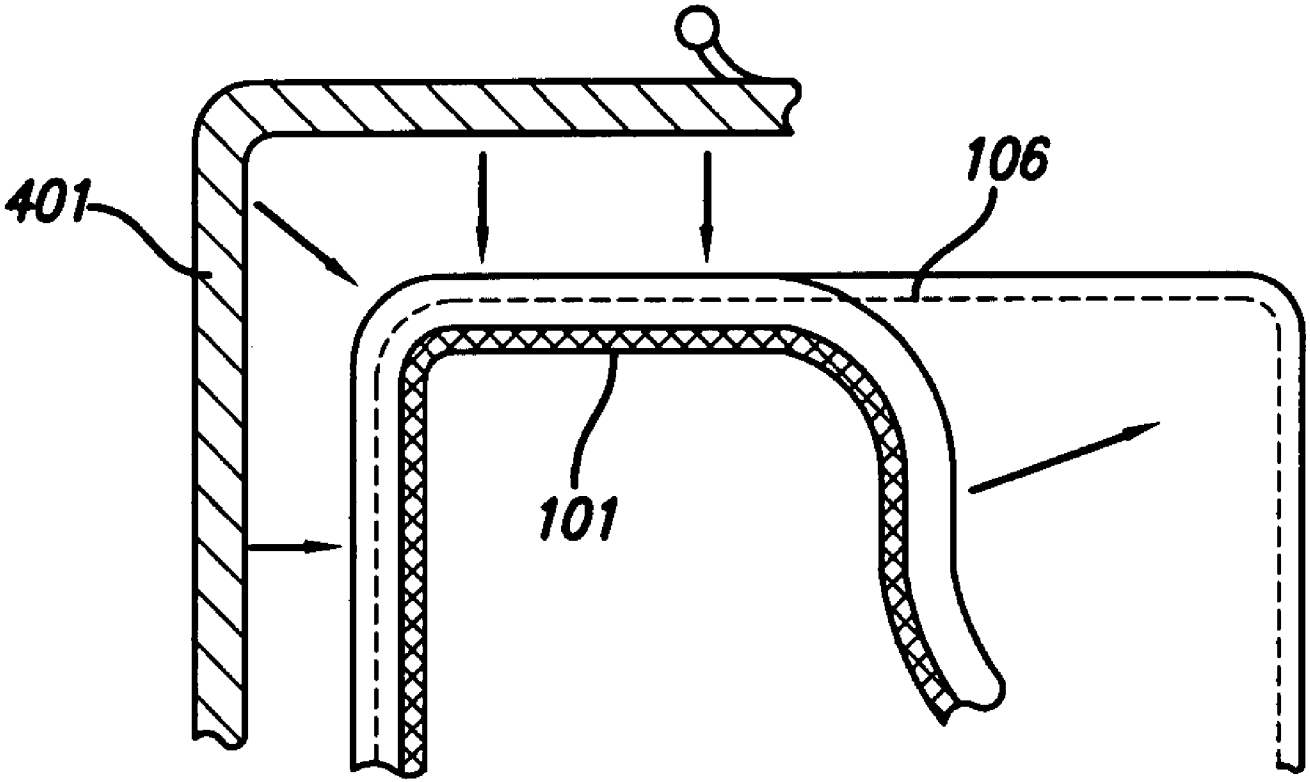
FIG. 7 illustrates an exploded view of the mounting of an electroluminescent wire to a fashion accessory in accordance with an embodiment of the present invention. A lip of the electroluminescent wire that runs along its axial length is secured (e.g., sewn) to the edge of the inside lining of the fashion accessory, around which the frame of the fashion accessory is subsequently fastened (e.g., by crimping).

As depicted in FIG. 2, the power source 102, inverter 109, and wires 104 may be included inside the fashion accessory 100, but may be further configured between a wall 105 and an interior lining 106 of the fashion accessory 100. This configuration of the power source 102, inverter 109, and wires 104 may obscure these elements from view when the fashion accessory 100 is open. Moreover, the illumination source 101 may be stitched or otherwise affixed to the fashion accessory 100. In one embodiment of the present invention (i.e., the fashion accessory 100 being a purse), the illumination source 101 may be stitched or otherwise affixed to the fashion accessory 100 around the perimeter of the interior lining 106; preferably at or near the border between the interior lining 106 and the wall 105. Stitching 107 may be included to secure the illumination source 101 to the fashion accessory 100 in this manner. Alternatively or in addition, the illumination source 101 may be secured to the fashion accessory 100 by mechanical sealing (e.g., crimping) of the frame 401 of the fashion accessory about the lip of the illumination source 101, as depicted in FIG. 7.

Figure 4:
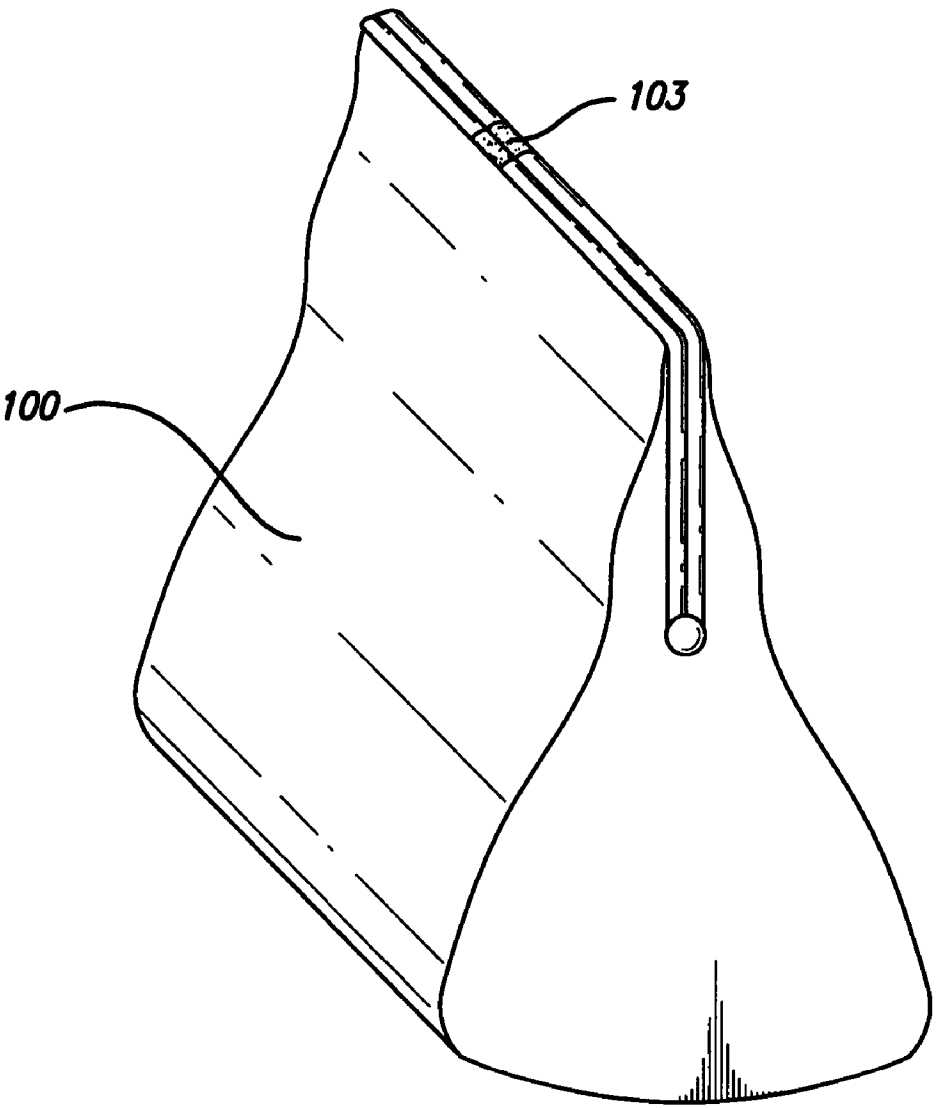
FIG. 4 illustrates a perspective view of a fashion accessory including an illumination device in accordance with an embodiment of the present invention. The fashion accessory is shown in a closed position.

The switch 103 of the present invention may be included at or near an opening 108 of the fashion accessory 100. As illustratively depicted in FIG. 1, the switch 103 is included at the opening 108 of a fashion accessory 100. When the fashion accessory 100 is open, the switch 103 causes the illumination source 101 to illuminate, and when the fashion accessory 100 is closed, the switch 103 causes the illumination source 101 to turn off. Depending on the overall configuration of the fashion accessory 100 and the remaining elements of the embodiment of the present invention that is included therewith, the switch 103 may be substantially obscured from view. However, in the embodiment illustratively depicted in FIG. 4, an individual may observe the switch 103. Therefore, in certain embodiments of the present invention, and particularly those embodiments wherein the switch 103 is configured to be visible when the fashion accessory 100 is in the open position, it may be desirable to select a relatively small switch 103.

While the description above refers to particular embodiments of the present invention, it will be understood that many modifications may be made without departing from the spirit thereof. The accompanying claims are intended to cover such modifications as would fall within the true scope and spirit of the present invention. The presently disclosed embodiments are therefore to be considered in all respects as illustrative and not restrictive, the scope of the invention being indicated by the appended claims, rather than the foregoing description, and all changes that come within the meaning and range of equivalency of the claims are therefore intended to be embraced therein.

What is claimed is:

1. A fashion accessory with an illumination apparatus to illuminate the interior thereof, comprising:

a dual illumination source including a first illumination source and a second illumination source;

a power source electrically coupled to the dual illumination source by a bifurcated wire; and a switch electrically coupled to the illumination source, wherein the dual illumination source comprises a pair of electric luminescent wires, and wherein the fashion accessory includes a frame, and the electric luminescent wires are secured in place in the fashion accessory by the frame.

2. The fashion accessory of claim 1, wherein the illumination source is activated when the switch is in an "on" position and the illumination source is deactivated when the switch is in an "off" position.

3. The fashion accessory of claim 2, wherein when the illumination source is activated, it glows with a color.

4. The fashion accessory of claim 1, wherein the switch is in the "on" position when the fashion accessory is open, and the switch is in the "off" position when the fashion accessory is closed.

5. The fashion accessory of claim 1, wherein the switch is a magnetic reed switch.

6. The fashion accessory of claim 1, further including an inverter configured between the power source and the dual illumination source, and electrically coupled thereto.

7. The fashion accessory of claim 1, wherein the illumination apparatus is concealed from view by a portion of the fashion accessory.

8. The fashion accessory of claim 1, selected from the group consisting of a purse, a handbag, a pocketbook, a wallet, a backpack, a briefcase, a satchel, an article of luggage, a suitcase, a case for sunglasses, and a case for makeup.

9. The fashion accessory of claim 1, wherein the power source is a rechargeable power source.

10. The fashion accessory of claim 9, further comprising means to establish electronic communication between the rechargeable power source and an external power source.

11. The fashion accessory of claim 10, wherein the external power source is selected from the group consisting of a cigarette lighter adapter, a wall outlet, and a solar power source.

12. The fashion accessory of claim 9, further comprising an internal fashion accessory power outlet.

13. The fashion accessory of claim 1, wherein the dual illumination source is configured such that neither the first illumination source nor the second illumination source transect a hinge in the fashion accessory.

14. A method for assembling a fashion accessory with an illumination device, comprising:

providing an illumination device, comprising:

a dual illumination source including a first illumination source and a second illumination source, a power source electrically coupled to the dual illumination source by a bifurcated wire, and a switch electrically coupled to the illumination source;

attaching the dual illumination source to an interior lining of the fashion accessory; and mechanically sealing a frame of the fashion accessory about a portion of the dual illumination source.

15. The method of claim 14, wherein the dual illumination source comprises a pair of electric luminescent wires.

16. The method of claim 14, wherein attaching the dual illumination source to the interior lining of the fashion accessory further comprises configuring the dual illumination source such that neither the first illumination source nor the second illumination source transect a hinge in the fashion accessory.

* * * * *